US005914570A

United States Patent [19]

Nerone et al.

[11] Patent Number: 5,914,570

[45] Date of Patent: Jun. 22, 1999

[54] COMPACT LAMP CIRCUIT STRUCTURE HAVING AN INVERTER/BOASTER COMBINATION THAT SHARES THE USE OF A FIRST N-CHANNEL MOSFET OF SUBSTANTIALLY LOWER ON RESISTANCE THAN ITS P-CHANNEL COUNTERPART

[75] Inventors: Louis R. Nerone, Brecksville; David J. Kachmarik, Strongsville, both of Ohio

[73] Assignee: General Electric Company, Schenectady, N.Y.

[21] Appl. No.: 08/922,203

[22] Filed: Sep. 2, 1997

Related U.S. Application Data

[60] Provisional application No. 60/033,819, Dec. 23, 1996.

[51] Int. Cl.[6] ..... H05B 37/02

[52] U.S. Cl. ..... 315/209 R; 315/247; 315/224; 315/307; 363/60

[58] Field of Search ..... 315/247, 209 R, 315/307, 224, DIG. 7; 363/16, 60, 17

[56] References Cited

U.S. PATENT DOCUMENTS

| | | | |
|---|---|---|---|
| 4,463,286 | 7/1984 | Justice | 315/219 |
| 4,546,290 | 10/1985 | Kerekes | 315/209 R |
| 4,588,925 | 5/1986 | Fahnrich et al. | 315/101 |
| 4,647,817 | 3/1987 | Fahnrich et al. | 315/104 |
| 4,677,345 | 6/1987 | Nilssen | 315/209 R |
| 4,692,667 | 9/1987 | Nilssen | 315/209 R |
| 4,937,470 | 6/1990 | Zeller | 307/270 |
| 4,939,427 | 7/1990 | Nilssen | 315/DIG. 7 |
| 4,945,278 | 7/1990 | Chern | 315/209 R |
| 4,949,016 | 8/1990 | De Bijl et al. | 315/DIG. 7 |
| 5,223,767 | 6/1993 | Kulka | 315/209 R |
| 5,309,062 | 5/1994 | Perkins et al. | 315/53 |
| 5,341,068 | 8/1994 | Nerone | 315/219 |
| 5,349,270 | 9/1994 | Roll et al. | 315/209 R |
| 5,355,055 | 10/1994 | Tary | 315/209 R |
| 5,387,847 | 2/1995 | Wood | 315/209 R |
| 5,406,177 | 4/1995 | Nerone | 315/307 |
| 5,408,403 | 4/1995 | Nerone | 363/37 |
| 5,514,981 | 5/1996 | Tam et al. | 326/80 |
| 5,712,536 | 1/1998 | Haas et al. | 315/247 |

*Primary Examiner*—Michael Shingleton
*Attorney, Agent, or Firm*—Charles E. Bruzga, Esq.

[57] ABSTRACT

A gas discharge lamp ballast comprises a load circuit including circuitry for connection to a gas discharge lamp. A circuit supplies d.c. power from an a.c. voltage. A d.c.-to-a.c. converter circuit is coupled to the load circuit for inducing a.c. current therein. The converter circuit comprises first and second converter switches serially connected in the foregoing order between a bus node at a d.c. voltage and a reference node, and being connected together at a common node through which the a.c. load current flows. The first and second converter switches each have a control node and a reference node, the voltage between such nodes determining the conduction state of the associated switch. The respective control nodes of the first and second converter switches are interconnected. The respective reference nodes of the first and second converter switches are connected together at the common node. A boost converter comprises a boost capacitor connected between the bus and reference nodes and whose level of charge determines the bus voltage on the bus conductor. A boost inductor stores energy from the circuit that supplies d.c. power, the boost inductor being connected by at least one diode to the boost capacitor, for discharging its energy into the boost capacitor. A boost switch periodically connects the boost inductor through a low impedance path to the bus node to thereby charge the boost inductor. The boost switch comprises the first switch of the converter circuit. The ballast achieves a high degree of power factor correction.

5 Claims, 1 Drawing Sheet

COMPACT LAMP CIRCUIT STRUCTURE HAVING AN INVERTER/BOASTER COMBINATION THAT SHARES THE USE OF A FIRST N-CHANNEL MOSFET OF SUBSTANTIALLY LOWER ON RESISTANCE THAN ITS P-CHANNEL COUNTERPART

This application claims priority from provisional application Ser. No. 60/033,819, filed on Dec. 23, 1996.

FIELD OF THE INVENTION

This invention relates to a ballast, or power supply circuit, for powering a gas discharge lamp with a.c. current and while achieving a high degree of power factor correction.

BACKGROUND OF THE INVENTION

It is known from U.S. Pat. No. 5,408,403, assigned to the present assignee, to employ a ballast for a gas discharge lamp incorporating a d.c.-to-a.c. converter using a pair of serially connected converter switches. A boost circuit is incorporated into the ballast to achieve a high degree of power factor correction. However, the converter switches are both of the same conduction type; e.g., both n-channel enhancement mode MOSFETs.

A lamp ballast incorporating a d.c.-to-a.c. converter using serially connected switches of complementary conduction types is disclosed and claimed in co-pending and commonly assigned application Ser. No. 08/709,062, filed Sep. 6, 1996, by Louis R. Nerone, one of the present inventors. For instance, one switch may be an n-channel enhancement mode MOSFET, while the other is a p-channel enhancement mode MOSFET.

It would be desirable to increase power factor correction in a ballast incorporating a d.c.-to-a.c. converter using switches of the same conduction type.

SUMMARY OF THE INVENTION

An exemplary embodiment of the invention provides a gas discharge lamp ballast. The ballast comprises a load circuit including circuitry for connection to a gas discharge lamp. A circuit supplies d.c. power from an a.c. voltage. A d.c.-to-a.c. converter circuit is coupled to the load circuit for inducing a.c. current therein. The converter circuit comprises first and second converter switches serially connected in the foregoing order between a bus node at a d.c. voltage and a reference node, and being connected together at a common node through which the a.c. load current flows. The first and second converter switches each have a control node and a reference node, the voltage between such nodes determining the conduction state of the associated switch. The respective control nodes of the first and second converter switches are interconnected. The respective reference nodes of the first and second converter switches are connected together at the common node. A boost converter comprises a boost capacitor connected between the bus and reference nodes and whose level of charge determines the bus voltage on the bus conductor. A boost inductor stores energy from the circuit that supplies d.c. power, the boost inductor being connected by at least one diode to the boost capacitor, for discharging its energy into the boost capacitor. A boost switch periodically connects the boost inductor through a low impedance path to the bus node to thereby charge the boost inductor. The boost switch comprises the first switch of the converter circuit.

The foregoing embodiment achieves a high degree of power factor correction in a ballast incorporating a d.c.-to-a.c. converter with switches of the same conduction type.

DETAILED DESCRIPTION OF THE INVENTION

Figure 1:
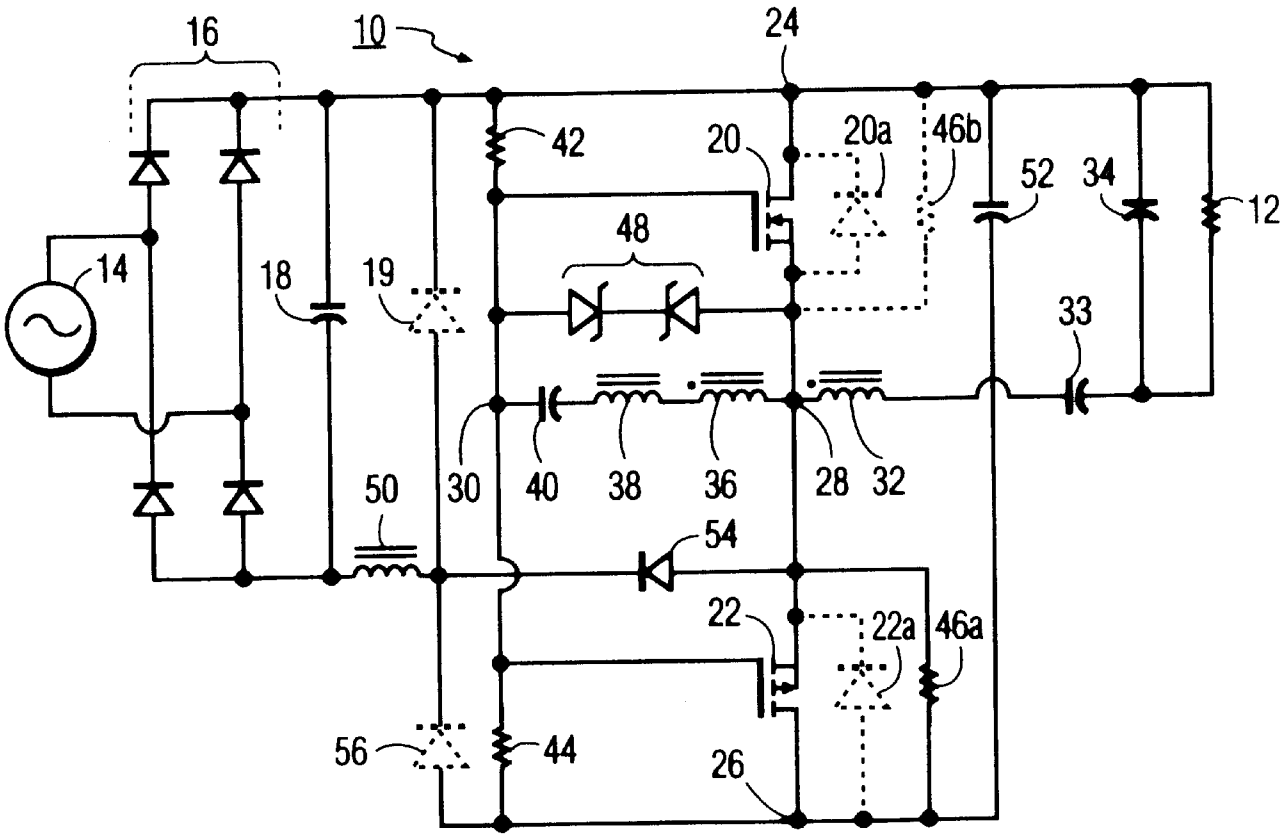
FIG. 1 is a schematic diagram of a ballast for achieving a low power factor.

FIG. 1 shows a ballast 10 for powering a gas discharge lamp 12, indicated as a resistance. A source 14 supplies a.c. power to a full-wave rectifier 16. A high frequency by-pass capacitor 18 is used for by-passing currents at the frequency of operation of the ballast 10 (as opposed to the line frequency of the power source 14). Optional p-n diode 19 minimizes parasitic voltage caused by a resonant interaction between a boost inductor 50 (described below) and a parasitic capacitance (not shown) between the output electrodes of switch 20.

Ballast 10 includes an d.c.-to-a.c. converter including a pair of switches 20 and 22 serially connected between a bus node 24 and a reference node 26. Switches 20 and 22 preferably comprise n-channel and p-channel enhancement-mode MOSFETs, respectively, as shown, with their sources interconnected at common node 28. The gates, or control nodes, of the switches are interconnected at control node 30.

In operation, node 28 is alternately connected between a bus potential on node 24, and a reference potential on node 26. In this way, an a.c. current is supplied to a load circuit including a resonant inductor 32, a d.c. blocking capacitor 33, a resonant capacitor 34, and lamp 12. Before discussing the circuitry used for achieving a low power factor, preferred circuitry for regeneratively controlling operation of switches 20 and 22 is described.

Regenerative control is provided in part by a driving inductor 36 mutually coupled to resonant inductor 32 with polarity dots as shown, a further inductor 38, and a capacitor 40. Regenerative control is also provided by a network preferably including resistor 42, resistor 44 and either resistor 46*a* shown in solid lines or alternate resistor 46*b* shown in dashed lines. Additionally, back-to-back Zener diode pair 48 is used for regenerative control. Upon initial energization of ballast 10, when a.c. source 14 is activated, capacitor 40 becomes charged until switch 22 turns on. Thereafter, through feedback supplied to driving inductor 38 from resonant inductor 32, the voltage of control node 30 alternatively becomes positive and then negative with respect to common node 26 so as to alternately turn on switches 20 and 22.

Although both resistors 42 and 44 are preferably used in the foregoing-described circuitry for regenerative control, resistor 44 may be deleted where resistor 46*a* is used, and resistor 42 may be deleted where resistor 46*b* is used.

Power factor correction is obtained by use of a boost converter including a boost inductor 50, a boost capacitor 52, and switch 20 used, in addition to its role in the mentioned d.c.-to-a.c. converter, as a boost switch. In operation, when switch 20 conducts, common node 28 is raised to the potential of bus node 24. At this time, boost inductor 50 conducts current from node 28 via p-n diode 54. As such, that inductor stores energy and, consequently, continues to conduct current when switch 20 stops conducting. Then, inductor 50 conducts current through either inherent p-n diode 22*a* of MOSFET switch 22, or through optional p-n diode 56, such current being mainly supplied by boost capacitor 52. This charges the capacitor so as to increase its voltage, and hence the potential of bus node 24.

The use of optional p-n diode 56 reduces the number of p-n diode voltage drops to only one in the conduction path from capacitor 52 to inductor 50, making energy storage in the inductor less lossy.

Thereafter, switch 22 begins to conduct, preferably after p-n diode 22 has started conducting, for instance, residual current from either inductor 32 or 50. This brings the potential of node 28 down to that of reference node 26, and causes current through the boost inductor 50 to decrease, preferably to zero.

The amount of energy stored in boost inductor 50 depends on where in the cycle of the source 14 of a.c. power, current is made to flow through the inductor. If this occurs at the peak of the a.c. power, the energy stored will be greatest; if near the zero crossings of the a.c. power, the energy stored will be lowest.

When current has been flowing from resonant inductor 32 into node 28, and both switches 20 and 22 are off, the energy stored in inductor 32 may cause current flow both into boost inductor 50, via diode 54, and through inherent p-n diode 20*a* of switch 20. Then, switch 20 begins to conduct, causing a reversal of current flow in resonant inductor 32 and increasing any current flow into boost inductor 50.

Preferably, switch 20, which carries the boost converter current in addition to the current used in the d.c.-to-a.c. conversion, has a substantially lower on-resistance than the other switch 22. This is realized in the ballast 10, wherein switch 20, preferably an n-channel enhancement mode MOSFET, has a lower on-resistance than switch 22, preferably a p-channel enhancement mode MOSFET.

Figure 2:
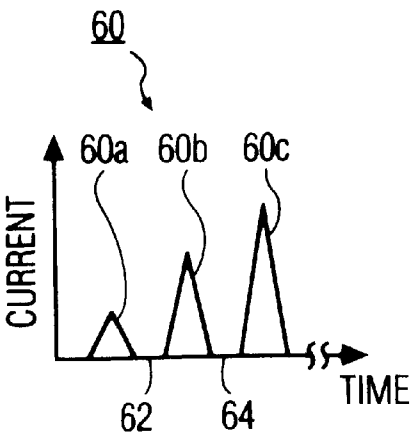
FIG. 2 is waveform of current in the boost inductor of FIG. 1.

FIG. 2 shows waveform 60 of current in boost inductor 50 (FIG. 1). Waveform 60 comprises triangular components 60*a*, 60*b*, 60*c*, etc., which are separated from each other by time intervals 62, 64, etc. This indicates energy storage in a discontinuous mode, which is preferable for increasing the power factor of the ballast. However, the time intervals between successive triangular components at the peak of the waveform (not shown) of the source 14 of a.c. power can approach and even reach zero while still maintaining a discontinuous mode of energy storage.

Exemplary component values for ballast 10 are as follows for a fluorescent lamp 12 rated at 16.5 watts, with a d.c. bus voltage of 330 volts:

| | | |
|---|---|---|
| Resonant inductor 32 | 2.1 | millihenries |
| Driving inductor 36 | 3.1 | microhenries |
| Turns ratio between inductors 32 and 36 | 26 | |
| Inductor 38 | 470 | microhenries |
| Capacitor 40 | 0.1 | microfarads |
| Zener diode pair 48, each | 10 | volts |
| Resistors 42, 44 and 46a or 46b, each | 270k | ohms |
| Resonant capacitor 34 | 2.2 | nanofarads |
| D.c. blocking capacitor | 0.22 | microfarads |
| Boost inductor 50 | 10 | millihenries |
| Boost capacitor 52 | 10 | microfarads |

Typically, a capacitor of about 5.6 nano farads (not shown) will be connected between nodes 28 and 30 to increase the so-called "dead" time wherein both switches 20 and 22 are off. Switch 20 may be an IRFR310, n-channel, enhancement mode MOSFET, sold by International Rectifier Company, of E1 Segundo, Calif.; and switch 22, an IRFR9310, p-channel, enhancement mode MOSFET also sold by International Rectifier Company.

A power factor of greater than 0.95 has been achieved with a ballast as described herein, with 20 percent or less total harmonic distortion of a.c. current supplied by a line source of a.c. power. With optimization, e.g., a boost of 2-to-1, the total harmonic distortion can often be reduced to under 13 percent.

While the invention has been described with respect to specific embodiments by way of illustration, many modifications and changes will occur to those skilled in the art. It is, therefore, to be understood that the appended claims are intended to cover all such modifications and changes as fall within the true scope and spirit of the invention.

What is claimed is:

1. A gas discharge lamp ballast, comprising:

(a) a load circuit with means for connection to a gas discharge lamp;

(b) means for supplying d.c. power from an a.c. voltage;

(c) a d.c.-to-a.c. converter circuit coupled to said load circuit for inducing a.c. current therein, said converter circuit comprising:

(i) an n-channel enhancement mode first MOSFET and a p-channel enhancement mode second MOSFET connected in the foregoing order between a bus node at a d.c. voltage and a reference node, and having their sources connected together at a common node through which said a.c. load current flows; and (ii) the respective gates of said first and second MOSFETs being interconnected; and (d) a boost converter comprising:

(i) a boost capacitor connected between said bus and reference nodes and whose level of charge determines the bus voltage on said bus conductor;

(ii) a boost inductor for storing energy from said means for supplying d.c. power, said boost inductor being connected by at least one diode to said boost capacitor, for discharging its energy into said boost capacitor; and (iii) a boost switch for periodically connecting said boost inductor through a low impedance path to said bus node to thereby charge said boost inductor;

(e) said boost switch comprising said first MOSFET;

(f) said first MOSFET having a substantially lower on resistance than said second MOSFET.

2. The ballast of claim 1, wherein said low impedance path includes a p-n diode allowing current flow from said boost switch to said boost inductor.

3. The ballast of claim 1, wherein the inductance of said boost inductor and the frequency of operation of said d.c.-to-a.c. converter circuit are selected to cause said boost inductor to operate with discontinuous energy storage throughout substantially the entire period of said a.c. voltage.

4. The power supply circuit of claim 1, wherein said d.c.-to-a.c. converter circuit includes a regenerative switch control circuit for controlling the switching state of said first and second MOSFETs.

5. The power supply circuit of claim 4, wherein said load circuit includes a fluorescent lamp.

* * * * *